US011708699B2

(12) United States Patent
Proot

(10) Patent No.: US 11,708,699 B2
(45) Date of Patent: Jul. 25, 2023

(54) DEFORMABLE FINISHING ACCESSORY SUITABLE FOR FORMING A CONNECTION BETWEEN TWO SURFACES

(71) Applicants: Bernard Proot, Marcq en Baroeul (FR); BRICONORD, Barbezieux-Saint-Hilaire (FR)

(72) Inventor: Bernard Proot, Marcq en Baroeul (FR)

(73) Assignees: Bernard Proot, Marcq en Baroeul (FR); Briconord, Barbezieux-Saint-Hilaire (FR)

( * ) Notice: Subject to any disclaimer, the term of this patent is extended or adjusted under 35 U.S.C. 154(b) by 0 days.

(21) Appl. No.: 16/959,763

(22) PCT Filed: Jan. 8, 2019

(86) PCT No.: PCT/EP2019/050283
§ 371 (c)(1),
(2) Date: Sep. 2, 2020

(87) PCT Pub. No.: WO2019/137887
PCT Pub. Date: Jul. 18, 2019

(65) Prior Publication Data

US 2021/0388624 A1 Dec. 16, 2021

(30) Foreign Application Priority Data

Jan. 9, 2018 (FR) ..... 1850148

(51) Int. Cl.
*E04F 19/06* (2006.01)
*E04F 11/16* (2006.01)
*E04F 19/04* (2006.01)

(52) U.S. Cl.
CPC ..... *E04F 19/066* (2013.01); *E04F 11/166* (2013.01); *E04F 19/0463* (2013.01); *E04F 19/063* (2013.01)

(58) Field of Classification Search
CPC ..... E04F 19/066; E04F 19/061; E04F 19/062; E04F 19/063; E04F 19/065; E04F 19/067;
(Continued)

(56) References Cited

U.S. PATENT DOCUMENTS 3,696,461 A * 10/1972 Kelly ..... A47G 27/045 16/16
4,156,300 A * 5/1979 Jarjavail ..... E04F 19/066 16/5

(Continued)

FOREIGN PATENT DOCUMENTS

BE 1019657 A3 9/2012
CN 1950577 A 4/2007

(Continued)

OTHER PUBLICATIONS

Int'l. Search Report for PCT/EP2019/050283, dated Mar. 18, 2019.

(Continued)

*Primary Examiner* — Kyle J. Walraed-Sullivan
(74) *Attorney, Agent, or Firm* — David D. Brush; Westman, Champlin & Koehler, P.A.

(57) ABSTRACT

A finishing accessory (1A) includes a deformable finishing profile (10) and at least one blocking part (P2A). The finishing profile (10) is suitable for making up a finishing transition between two surfaces (S1; S2), and includes two rigid wings (100; 101) that extend lengthwise parallel to a longitudinal axis (A), which are spaced from one another and which are intended to be in contact respectively with the two surfaces (S1; S2) to be connected, and a flexible hinge (102) that extends lengthwise parallel to said longitudinal axis (A), which is, at least in part, positioned between the two wings (100; 101), and which connects the two wings to one another while allowing a rotation of the two wings (100; 101) relative to one another in a plane (X, Y) perpendicular to the longitudinal axis (A). Said blocking part (P2A)

(Continued)

includes an adjusting shim (20*a*), which extends lengthwise and which, once inserted into a longitudinal groove (103) of the finishing profile, is adapted to block the two wings (100; 101).

17 Claims, 9 Drawing Sheets

(58) Field of Classification Search
CPC ..... E04F 19/068; E04F 19/0463; E04F 19/06; E04F 19/02; E04F 11/16; E04F 15/14; A47G 27/04; A47G 27/00
See application file for complete search history.

(56) References Cited

U.S. PATENT DOCUMENTS

| | | | | |
|---|---|---|---|---|
| 4,893,449 | A * | 1/1990 | Kemper | E04F 19/061 52/464 |
| 5,155,952 | A * | 10/1992 | Herwegh | E04B 1/6803 52/100 |
| 5,657,598 | A * | 8/1997 | Wilbs | A47G 27/045 403/122 |
| 6,047,506 | A * | 4/2000 | Kemper | E04F 19/066 52/179 |
| 6,230,385 | B1 * | 5/2001 | Nelson | E04F 19/062 29/450 |
| 6,340,264 | B1 * | 1/2002 | Nelson | E04F 19/062 403/297 |
| 6,345,480 | B1 * | 2/2002 | Kemper | E04F 19/063 52/395 |
| 6,745,534 | B2 | 6/2004 | Kornfalt | |
| 7,207,143 | B2 * | 4/2007 | Stanchfield | E04D 1/365 52/312 |
| 7,409,802 | B2 * | 8/2008 | Fiedler | E04D 1/365 52/287.1 |
| 8,099,921 | B2 | 1/2012 | Muehleback | |
| 2001/0005539 | A1 * | 6/2001 | Neuhofer, Jr. | E04F 19/062 428/122 |
| 2002/0050109 | A1 * | 5/2002 | Grosjean | E04F 19/066 52/393 |
| 2002/0095895 | A1 * | 7/2002 | Daly | E04F 19/062 52/464 |
| 2003/0051426 | A1 * | 3/2003 | Kornfalt | E04F 19/063 52/396.1 |
| 2003/0084634 | A1 * | 5/2003 | Stanchfield | E04F 19/061 52/464 |
| 2005/0188628 | A1 * | 9/2005 | Sondermann | E04F 11/166 52/179 |
| 2006/0150565 | A1 * | 7/2006 | Schacht | E04F 19/061 52/716.1 |
| 2007/0199275 | A1 * | 8/2007 | Kurz | E04F 19/068 52/716.1 |
| 2008/0034696 | A1 * | 2/2008 | Neuhofer | E04F 19/061 52/466 |
| 2008/0115441 | A1 * | 5/2008 | Sondermann | E04F 19/066 52/395 |
| 2009/0139167 | A1 | 6/2009 | Donaldson et al. | |
| 2010/0031596 | A1 * | 2/2010 | Muehlebach | E04F 19/066 52/466 |

FOREIGN PATENT DOCUMENTS

| | | | | |
|---|---|---|---|---|
| CN | 101099014 | A | 1/2008 | |
| CN | 201099976 | Y | 8/2008 | |
| CN | 101278097 | A | 10/2008 | |
| CN | 203783075 | U | 8/2014 | |
| DE | 1714532 | U | 1/1956 | |
| EP | 1020590 | A2 | 7/2000 | |
| FR | 2695671 | A1 | 3/1994 | |
| FR | 2737237 | A1 | 7/1997 | |
| FR | 2783854 | A1 | 3/2000 | |
| FR | 2848234 | A1 | 6/2004 | |
| GB | 2458762 | A * | 10/2009 | E04F 19/062 |
| JP | S567808 | U | 1/1981 | |
| RU | 108470 | U1 | 9/2011 | |
| WO | 2008092561 | A1 | 8/2008 | |
| WO | 2013041797 | A1 | 3/2013 | |
| WO | 2014012518 | A2 | 7/2014 | |

OTHER PUBLICATIONS

First Office Action issued in corresponding Chinese Patent Appln. No. 201980007881.0, dated Jul. 13, 2021.
Search Report issued in corresponding Russian Patent Appln. No. 2020119918, dated Feb. 14, 2022.
Office action issued in corresponding Chinese Patent Appln. No. 201980007881.0, dated Oct. 8, 2022.
English translation of the Written Opinion dated Mar. 18, 2023, for corresponding International Application No. PCT/EP2019/050283, filed Jan. 8, 2019.

* cited by examiner

DEFORMABLE FINISHING ACCESSORY SUITABLE FOR FORMING A CONNECTION BETWEEN TWO SURFACES

TECHNICAL FIELD

The present invention relates to a new deformable finishing accessory suitable for forming a transition between two surfaces, and in particular relates to the field of interior decoration.

PRIOR ART

In the particular case of laying floor coverings, with floating or bonded installation, made from wood or the like, or of laying vinyl, carpet or tiled floor coverings, it is usual to use different types of wooden or similar, plastic or metal finishing accessories, which may or may not be covered with a decorative film, in order to make esthetic fittings of the threshold strip type, for example to connect two contiguous and separate floor coverings, or to connect a floor covering and the floor.

Finishing accessories allowing esthetic connections to be made between two surfaces, and for example threshold strips, are in particular described in French patent applications FR 2,737,237, FR 2,848,234, FR 2,695,671, FR 2,783,854, and in U.S. Pat. No. 6,745,534.

In the aforementioned publications FR 2,848,234, FR 2,695,671, FR 2,783,854, and U.S. Pat. No. 6,745,534, the finishing accessory can be fixed between the two surfaces to be connected with a slight angular clearance making it possible to make up for differences in level between the two surfaces. However, the technical solutions proposed in these publications are not suitable for reliably and mechanically solidly making up for level differences between the two surfaces, which can be very different from one application to another. The technical solutions proposed in these publications are therefore "mono-function," that is to say, suitable for forming a finishing transition between two surfaces in a very limited range of level deviations between the surfaces to be connected.

International patent application WO 2014/102518 also proposes different finishing accessory solutions implementing a finishing profile that is suitable for forming a finishing transition between two surfaces, and which is deformable so as to allow a level correction between the two surfaces. These solutions are interesting because they allow the finishing accessory to be easily adapted to different level differences between surfaces by deforming the finishing profile appropriately. However, on the one hand, these solutions, and in particular the solution of FIG. 23 of this international patent application WO 2014/102518, are suitable for thick floor coverings, but have too large a space requirement in terms of height, which makes them unsuitable for thin floor coverings, such as vinyl floor coverings called LVT, in particular floor coverings composed of LVT planks or tiles, the thickness of which is generally less than 6 mm.

Purpose of the Invention

One objective of the invention is to propose a new finishing accessory which is adapted to form a finishing transition between two surfaces, which is easily and robustly adaptable so as for example to make up for a level difference between two surfaces if necessary and/or so as for example to connect two surfaces that are oriented substantially transversely, and in particular perpendicularly to each other, and which may have a small overall space requirement in terms of height so as in particular to be able to be implemented with thin floor coverings.

Another objective of the invention is to propose a new finishing accessory, which is adapted to form a finishing transition between two surfaces, which is robust and easy to mass produce.

SUMMARY OF THE INVENTION

These aforementioned objectives are achieved by the finishing accessory having the following main technical features. Said f finishing accessory comprises a deformable finishing profile and at least one blocking part; said finishing profile is suitable for making up a finishing transition between two surfaces, and comprises two rigid wings that extend lengthwise parallel to a longitudinal axis, which are spaced from one another and which are intended to be in contact respectively with the two surfaces to be connected, and a flexible hinge that extends lengthwise parallel to said longitudinal axis, which is, at least in part, positioned between the two wings, and which connects the two wings to one another while allowing a rotation of the two wings relative to one another in a plane perpendicular to the longitudinal axis; each wing has, on its underside, a rigid longitudinal projection that extends lengthwise parallel to said longitudinal axis; the flexible hinge and the two longitudinal projections define a longitudinal groove between them; said blocking part comprises an adjusting shim, which extends lengthwise, which is capable of being inserted into said longitudinal groove and which, once inserted into said longitudinal groove, acts as a stop preventing the two longitudinal projections from being brought closer to one another so as to block the inward rotation of the two wings in relation to one another in a plane perpendicular to the longitudinal axis and in the first directions of rotation of the lower faces of the wings towards one another, with a predefined angular orientation of the two wings relative to one another.

More particularly, but optionally, the finishing accessory of the invention can comprise the following additional and optional technical characteristics, taken alone or in combination:

- the entire flexible hinge is positioned between the two wings.
- the flexible hinge extends over the entire length of the wings.
- the upper face of the flexible hinge is located in the extension of the upper faces of the two wings so as to form an upper face of the finishing profile that is uniform without recess and without roughness at the junction between each wing and the hinge.
- the finishing accessory comprises means for blocking in rotation that prevent the separation of the two longitudinal projections relative to one another so as to block the outward rotation of the two wings relative to one another in the plane perpendicular to the longitudinal axis and in the directions of rotation of the lower faces of the wings opposite the first directions of rotation, with a predefined angular orientation of the two wings relative to one another.
- the rotational blocking means form an integral part of the blocking part.
- the rotational blocking means comprise two lateral stops that extend lengthwise on either side of the adjusting shim while being spaced apart from the adjusting shim and which have the function of laterally outwardly blocking the wings of the profile relative to one another.

the finishing accessory comprises at least two separate blocking parts, and preferably at least three separate blocking parts, each blocking part corresponding to at least one different angular orientation of the two wings.

at least one blocking part is reversible so as to allow the two wings to be blocked in rotation relative to one another in at least two different angular orientations.

each blocking part is capable of being assembled with the finishing profile so as to form a monolithic assembly.

the finishing accessory comprises a fixing rail with which at least one blocking part is able to be fitted.

at least one blocking part comprises a knock-in screw.

the finishing profile is in one piece or consists of an assembly.

the material forming the hinge is different from the material forming the two wings.

the finishing profile is an extruded profile, and more particularly a co-extruded profile.

at least one blocking part is adapted to block the two wings in inward rotation with respect to one another with an external angle (A1), between the upper faces of the wings and measured at the junctions of the hinge with the wings, equal to 180°.

at least one blocking part is adapted to block the two wings in inward rotation with respect to one another with an external angle (A2), between the upper faces of the wings and measured at the junctions of the hinge with the wings, of between 180° and 270°.

at least one blocking part is adapted to block the two wings in inward rotation with respect to one another with an external angle (A3), between the upper faces of the wings and measured at the junctions of the hinge with the wings, equal to 270°.

preferably, the flexible hinge allows a rotation of the two wings relative to one another in a plane perpendicular to the longitudinal axis, without stretching and without compression of the hinge.

According to another aspect, the invention also relates to a finishing accessory comprising a deformable finishing profile and at least one blocking part; said finishing profile is suitable for making up a finishing transition between two surfaces, and comprises two rigid wings that extend lengthwise parallel to a longitudinal axis, which are spaced from one another and which are intended to be in contact respectively with the two surfaces to be connected, and a flexible hinge that extends lengthwise parallel to said longitudinal axis, which is, at least in part, positioned between the two wings, and which connects the two wings to one another while allowing a rotation of the two wings relative to one another in a plane perpendicular to the longitudinal axis, the component material of the hinge being different from the component material of the two wings; said blocking part is adaptable on the profile so as to block the inward rotation of the two wings in relation to one another in a plane perpendicular to the longitudinal axis and in the first directions of rotation of the lower faces of the wings towards one another, with a predefined angular orientation of the two wings relative to one another. The invention also relates to the use of the aforementioned finishing accessory as a finishing transition between two surfaces, and in particular between two floor coverings, or between a floor covering and the floor, or between two wall coverings, or between a wall covering and a wall on which the wall covering is fixed, or between two surfaces that are oriented transversely, and in particular perpendicularly, with respect to one another.

The invention also relates to a method of installing the above-mentioned finishing accessory, to form a finishing transition between two surfaces, during which the two wings of the finishing profile are blocked in rotation by means of at least one blocking part, if necessary by inserting the adjusting shim of the blocking part into the groove of the finishing profile, and said at least one blocking part is fixed between the two surfaces to be connected with the two wings in contact respectively with the two surfaces to be connected.

More particularly, in a variant, the two surfaces are substantially coplanar or are not coplanar and the finishing profile is adapted to make up for a difference in level between the two surfaces that are not coplanar.

More particularly, in another variant, the two surfaces are oriented transversely, and in particular substantially perpendicularly, with respect to one another.

BRIEF DESCRIPTION OF THE DRAWINGS

Other features and advantages of the invention will become apparent from reading the detailed description below of several embodiments of the invention, which variants are described as non-limiting and non-exhaustive examples of the invention, and with reference to the accompanying drawings in which.

DETAILED DESCRIPTION

Figure 1:
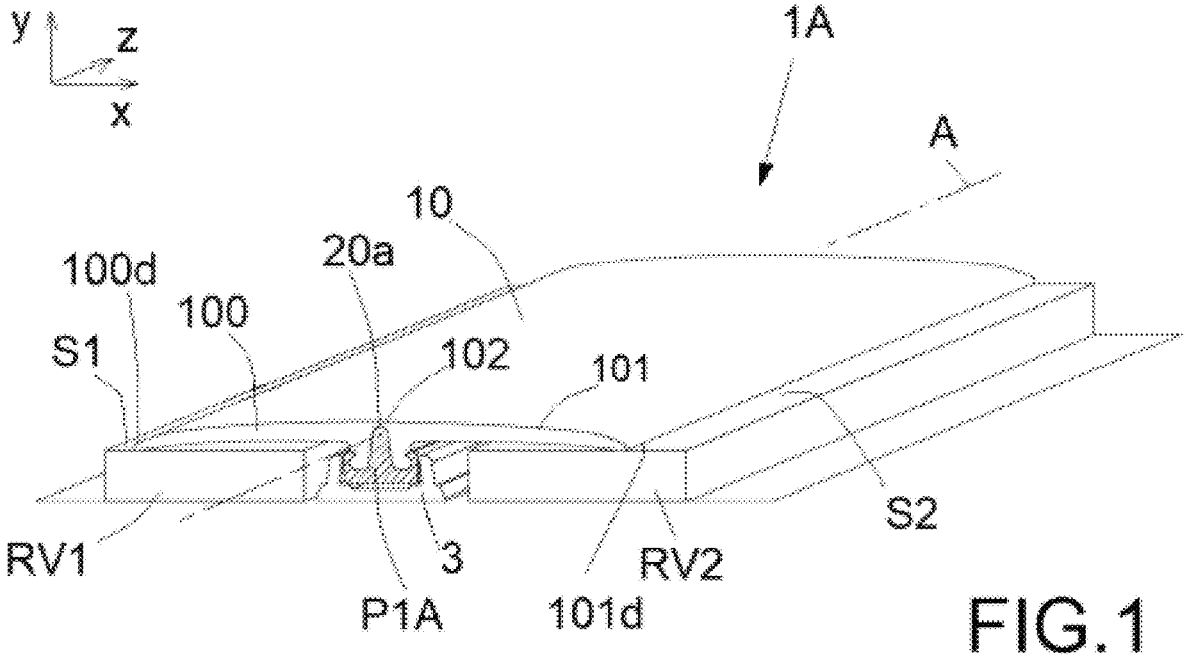
FIG. 1 is an isometric perspective view of a first variant embodiment of a finishing accessory according to the invention whose deformable finishing profile forms a transition between two floor coverings of substantially equal thickness.
Figure 5:
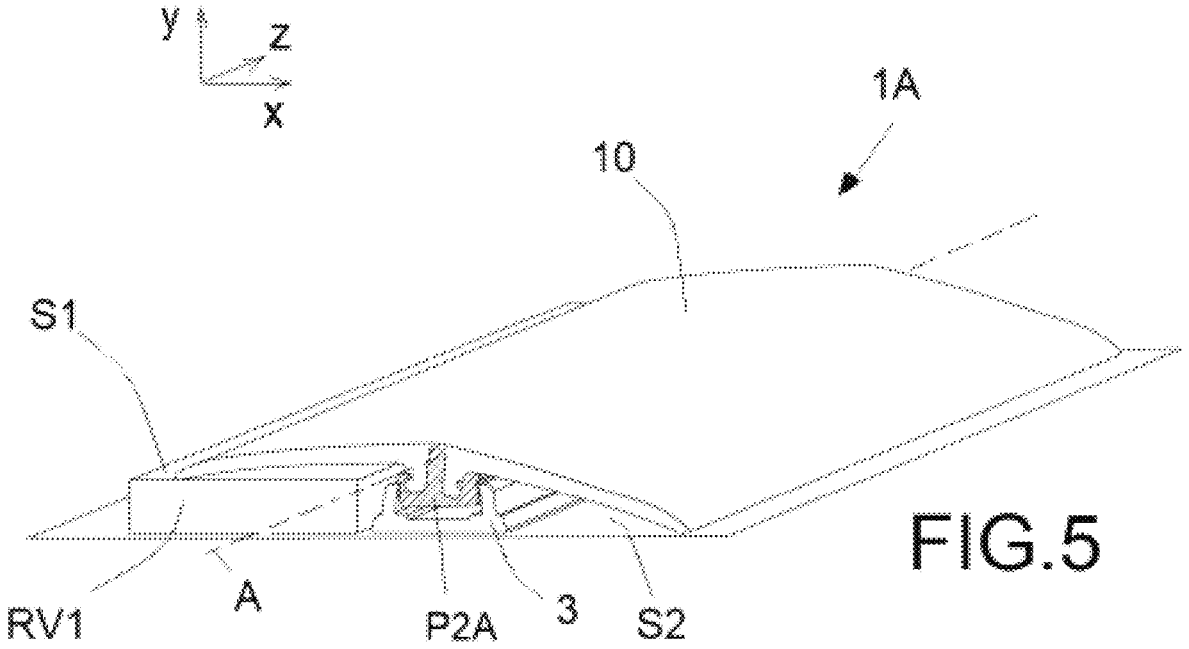
FIG. 5 is an isometric perspective view of said first variant embodiment of a finishing accessory according to the invention, the deformable finishing profile of which forms a transition between a floor covering and the floor.

FIGS. 1 and 5 show a first variant embodiment of a finishing accessory 1A comprising a deformable finishing profile 10, of longitudinal axis A, which extends in length in the direction Z.

In this variant embodiment, the deformable finishing profile 10 is a one-piece profile, that is to say a profile made in a single piece.

This one-piece finishing profile 10 can for example be manufactured by extrusion, and more particularly by co-extrusion.

Figure 4:
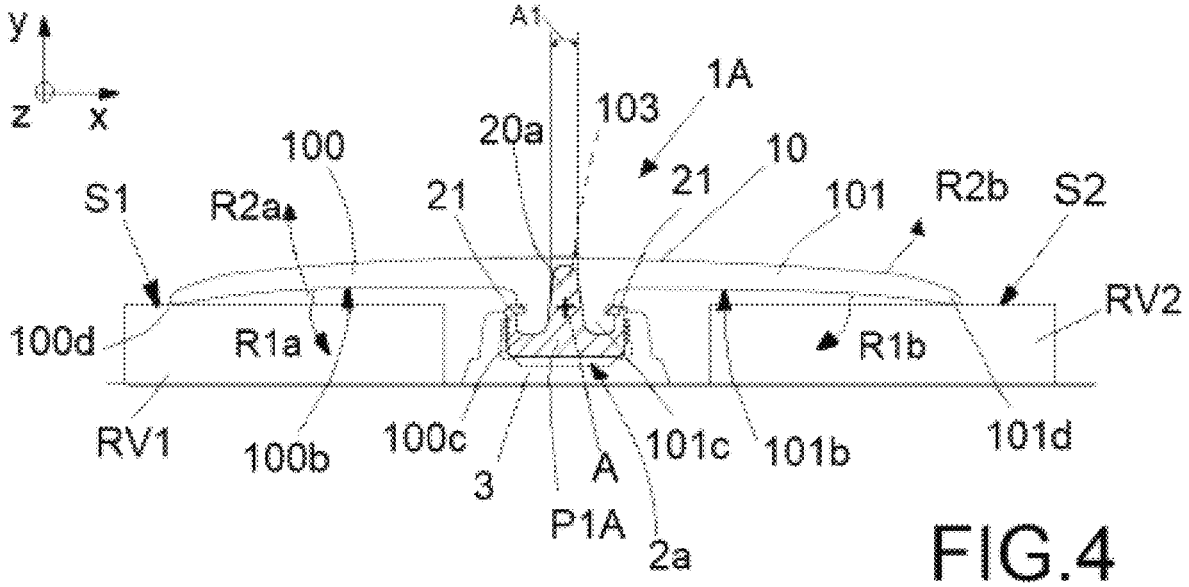
FIG. 4 is a cross-sectional view of the finishing accessory of FIG. 1.

In FIGS. 1 and 4, this finishing profile 10 is used to form a finishing transition between two substantially coplanar surfaces S1 and S2 respectively formed by the upper faces of two floor coverings RV1 and RV2 that are of substantially the same thickness.

Figure 8:
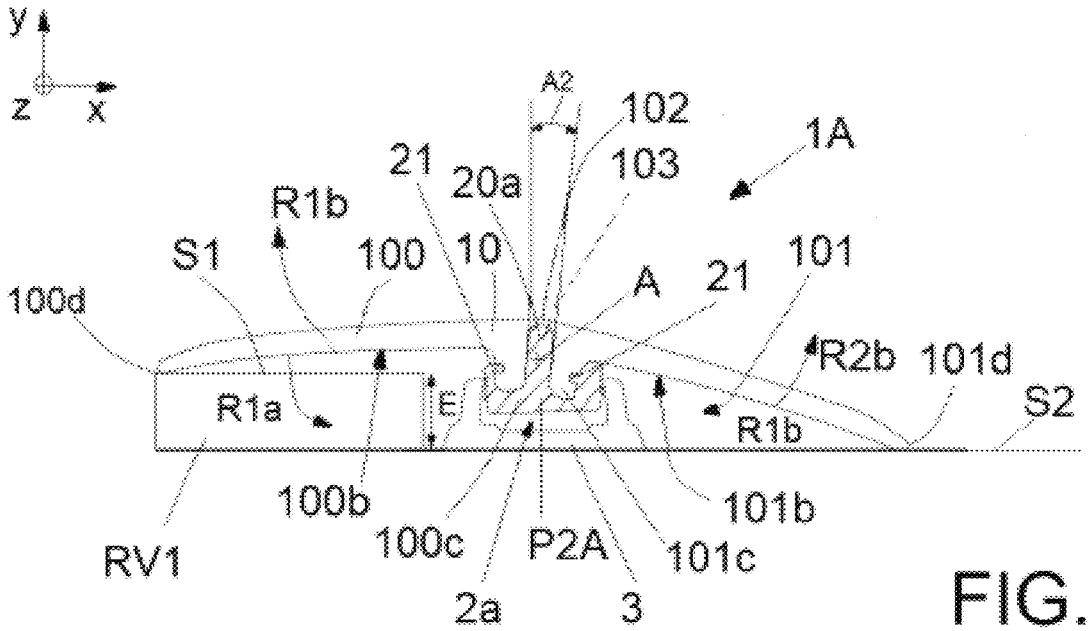
FIG. 8 is a cross-sectional view of the finishing accessory of FIG. 5.

In FIGS. 5 and 8, this finishing profile 10 is used to form a finishing transition between two surfaces S1 and S2 having a level difference E, and for example between the upper face S1 of a floor covering RV1 and the floor on which this floor covering is placed.

Figure 3:
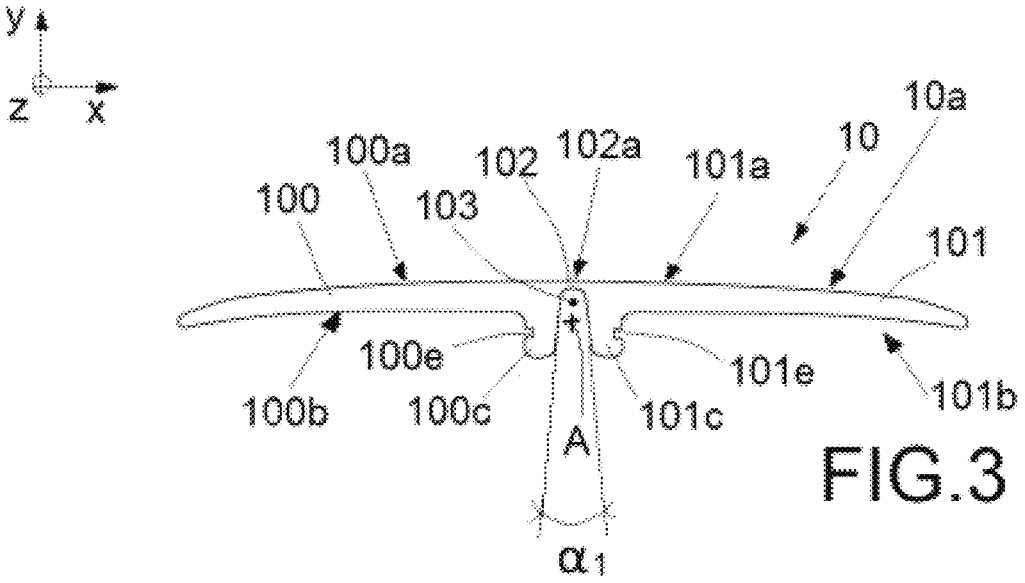
FIG. 3 is a cross-sectional view of the finishing profile of the finishing accessory of FIG. 1.
Figure 7:
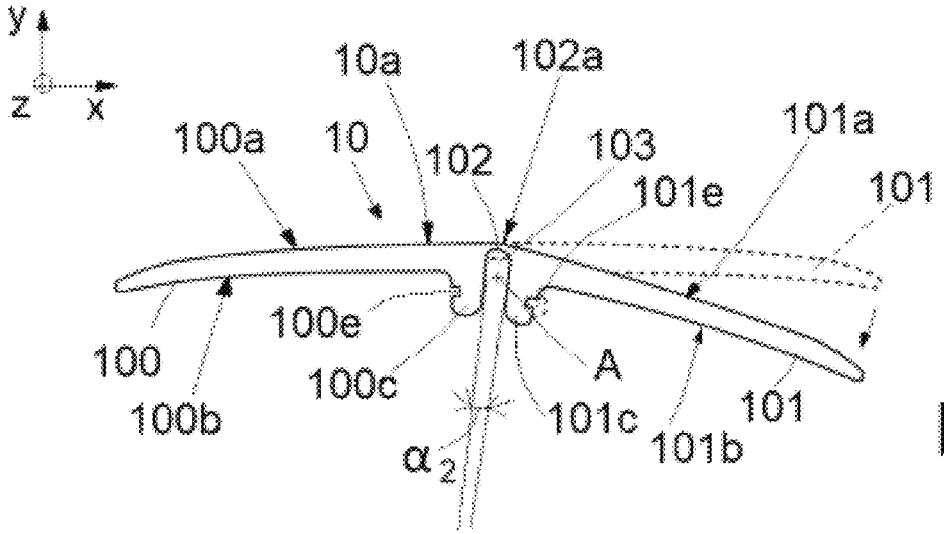
FIG. 7 is a cross-sectional view of the finishing profile of the finishing accessory of FIG. 5.

In reference to FIG. 3 or FIG. 7, this finishing profile 10 comprises two rigid wings 100 and 101, of small thickness and of equal length, which extend lengthwise parallel to the longitudinal axis A, which are spaced from each other, and which are intended to be in contact respectively with the two surfaces S1, S2. These two wings 100 and 101 are connected to one another over their entire length by a flexible hinge 102 that is thinner than the wings 100 and 101.

This hinge 102 is positioned in its entirety between the two wings 100 and 101 and extends lengthwise parallel to said longitudinal axis A.

This flexible hinge 102 allows rotation of the two wings 100, 101 relative to one another in the plane (X, Y) perpendicular to the longitudinal axis A, preferably without stretching or compression of the hinge 102, and therefore without modifying the dimensions of the upper face of the flexible hinge 102.

Preferably, the flexible hinge 102 is made so that its upper face 102*a* is in the extension of the two upper faces 100*a* and 101*a* of the wings 100 and 101, so as to form a finishing profile 10 whose upper face 10*a* is uniform, without recess and without roughness at the junction between each wing 100, 101 and the hinge 102. This upper face 10*a* of the finishing profile 10 constitutes the visible face of the finishing profile 10, that is to say, the part of the finishing profile that is visible once the finishing accessory is installed as a finishing transition between two surfaces S1 and S2.

Where appropriate, the upper face 10*a* of the finishing profile 10, including the flexible hinge 102, can be coated with a decorative film (not shown in the figures) that does not prevent the rotation of the two wings 100 and 101 relative to each other in the plane (X, Y) perpendicular to the longitudinal axis A.

The wing 100 has, on its lower face 100*b*, a rigid longitudinal projection 100*c* that extends lengthwise parallel to said longitudinal axis A. The wing 101 has, on its lower face 101*b*, a rigid longitudinal projection 101*c* that extends lengthwise parallel to said longitudinal axis A.

The flexible hinge 102 and the two longitudinal projections 100*c*, 101*c* define a longitudinal groove 103 between them that extends lengthwise parallel to the longitudinal axis A.

The component material(s) of the wings 100 and 101 and the hinge 102 are not important for the invention.

The component material of the flexible hinge 102 may be the same as that of the rigid wings 100 and 101.

In a preferred variant embodiment, the component material of the flexible hinge 102 is different from that of the rigid wings 100 and 101. More specifically, the wings 100 and 101 can for example be made from plastic of the PVC type or from metal, and the hinge 102 can for example be made from elastomer or from a different plastic. The flexible hinge 102 can be made from a material different from that of the wings 100 and 101, for example from the same type of polymer or elastomer as the wings 100 and 101, but with different hardnesses for the hinge 102 on the one hand and the wings 100, 101 on the other hand, the hardness of the material of the hinge 102 being lower than the hardness of the material of the wings 100, 101.

Preferably, but not necessarily, extrudable materials will be used so as to produce the finishing profile 10 by extrusion or by co-extrusion.

In the context of the invention, the deformable finishing profile according to the invention can also be manufactured using any other manufacturing method, and in particular by machining or by molding or by assembly.

The finishing profile 10 can be used with two different blocking parts P1A (FIGS. 1, 2 and 4) and P2A (FIGS. 5, 6 and 8), each blocking part P1A and P2A corresponding to a different angular orientation of the two wings 100 and 101 relative to one another. The blocking part P1A is used to block the wings 100 and 101 of the finishing profile 10 with the first angular orientation of the wings 100 and 101 of FIG. 3 (angle $\alpha$1). The blocking part P2A is used to block the wings 100 and 101 of the finishing profile 10 with the second angular orientation of the wings 100 and 101 of FIG. 7 (angle $\alpha$2).

Each blocking part P1A and P2A is formed by a profile that extends lengthwise. In the variant of FIGS. 1 to 8, this blocking part P1A and P2A extends over the entire length of the finishing profile 10. In another variant, in a manner comparable in particular to the variants of FIGS. 9 and 10, each blocking part P1A and P2A can be of shorter length than the finishing profile 10, and for each angular orientation of the two wings 100 and 101 it is possible to implement several blocking parts P1A or P2A spaced apart and distributed over the length of the deformable finishing profile 10.

Figure 2:
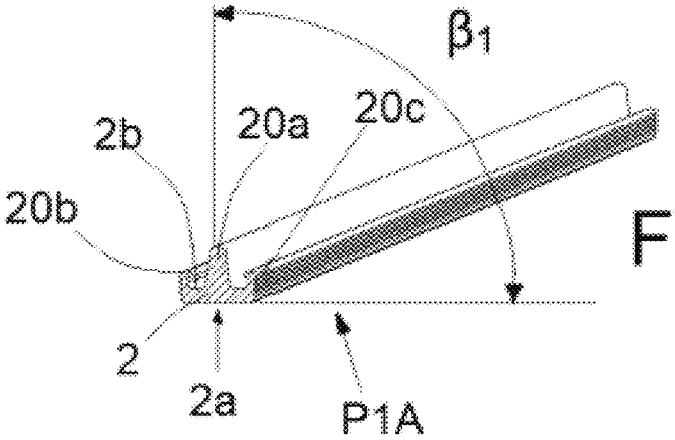
FIG. 2 is an isometric perspective view of the blocking part of the finishing accessory of FIG. 1.
Figure 6:
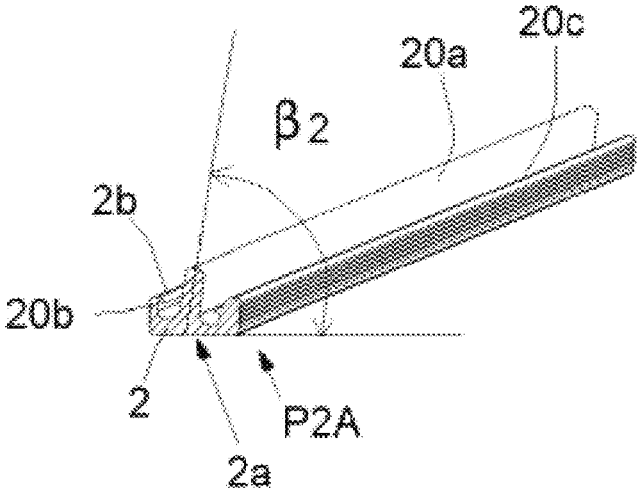
FIG. 6 is an isometric perspective view of the blocking part of the finishing accessory of FIG. 5.

In reference to FIGS. 2 and 6, each blocking part P1A or P1B comprises a longitudinal base 2, having a lower face 2*a* and an upper face 2*b*, two longitudinal rims 20*b* and 20*c* with a lateral stop function, which extend lengthwise and project from the upper face 2*b* of the base 2, and a central wall 20*a*, which extends lengthwise and is positioned between the two longitudinal edges 20*b* and 20*c* while projecting from the upper face 2*b*. The two longitudinal rims 20*b* and 20*c* are spaced apart from the adjusting shim 20*a* and define, with the adjusting shim, two housings in which the two longitudinal projections 100*c*, 101*c* can be inserted, respectively.

In this variant, the height of the central wall 20*a* is greater than the height of the two longitudinal rims 20*b*, 20*c*.

This central wall 20*a* forms an adjusting shim, which is capable of being inserted into the longitudinal groove 103 of the finishing profile 10 (FIG. 4 and FIG. 8) and which, once inserted into said longitudinal groove 103, acts as a stop preventing the two longitudinal projections 100*c* and 101*c* of the finishing profile 10 from being brought closer to one another, so as to block the two wings 100, 101 in inward rotation with respect to one another in the plane (X, Y) perpendicular to the longitudinal axis A and in the directions of rotation R1*a*, R1*b* of the lower faces 100*b*, 101*b* of the wings 100, 101 towards one another, with a predefined angular orientation of the two wings 100, 101 relative to one another.

In the variant of FIGS. 1 to 8, the blocking part P1A or P2A is designed to be fitted with clamping in a fixing rail 3 that is fixed to the floor, such that (FIGS. 4 and 8) the lower face 2*a* of the base 2 is substantially parallel to the two surfaces S1 and S2 to be connected.

In reference to FIGS. 1, 2 and 4, the central wall 20*a* acting as an adjusting shim for the blocking part P1A is oriented perpendicular to the lower face 2*a* of the base 2 (FIG. 2/angle β1 equal to 90°) and is adapted, once inserted into the groove 103 of the finishing profile 10, to block the two wings 100, 101 in rotation relative to one another in the plane (X, Y) perpendicular to the longitudinal axis A and in the directions of rotation R1*a*, R1*b* with a first particular angular orientation of the two wings 100, 101 (angle α1 in FIG. 3 and angle A1 of 180° in FIG. 4) allowing a connection of two surfaces S1 and S2 of equal level. The angle A1 corresponds to the external angle between the upper faces 100*a* and 101*a* of the two wings 100 and 101, measured at the junctions of the hinge 102 with the wings 100 and 101.

More particularly in this first angular orientation, the two longitudinal edges 100*d* and 101*d* (FIGS. 1 and 4) of the two wings 100 and 101 intended to be in contact with the two surfaces S1 and S2, respectively, are in a plane parallel to the lower face 2*a* of the base 2.

In reference to FIGS. 5, 6 and 8, the central wall 20*a* acting as an adjusting shim for the blocking part P2A is inclined relative to the lower face 2*a* of the base (FIG. 6/angle β2 less than 90° and on the order of 75°) and is adapted, once inserted into the groove 103 of the finishing profile 10, to block the two wings 100, 101 in rotation relative to one another in the plane (X, Y) perpendicular to the longitudinal axis A and in the directions of rotation R1*a*, R1*b* with a second particular angular orientation of the two wings 100, 101 (angle α2 in FIG. 7 and angle A2 in FIG. 8 between 180° and 270°) allowing a connection of two surfaces S1 and S2 having a level difference E. The angle A2 corresponds to the external angle between the upper faces 100*a* and 101*a* of the two wings 100 and 101, measured at the junctions of the hinge 102 with the wings 100 and 101.

More particularly in this second first angular orientation, the two longitudinal edges 100*d* and 101*d* (FIG. 8) of the two wings 100 and 101 intended to be in contact with the two surfaces S1 and S2, respectively, are in a plane that is not parallel to the lower face 2*a* of the base 2.

In the particular variant embodiments illustrated in the figures, once the adjusting shim 20*a* is inserted into said longitudinal groove 102 of the finishing profile 10, the two longitudinal rims 20*b*, 20*c* of the blocking part P1A or P2A also act, on either side of the adjusting shim 20, as lateral stops for the projections 100*c* and 101*c*, and have the function of laterally outwardly blocking the projections 100*c* and 101*c*. The two longitudinal rims 20*b*, 20*c* of the blocking part P1A or P2A thus allow a rotational blocking preventing the separation, relative to one another, of the two longitudinal projections 100*c* and 101*c* of the finishing profile 10. An outward rotational blocking of the two wings 100, 101 relative to one another is thus obtained in the plane (X, Y) perpendicular to the longitudinal axis A and in the directions of rotation R2*a* and R2*b* (FIGS. 4 and 8) respectively opposite the directions of rotation R1*a* and R1*b*.

More particularly, each lateral stop 20*b*, 20*c* of the blocking part P1A or P2A further comprises a longitudinal lug 21 that is able to be inserted into a corresponding longitudinal slot 100*e*, 101*e* (FIGS. 3 and 7) arranged in each projection 100*c*, 101*c* of the finishing profile 10, so as to assemble the blocking part P1A or P2A with the finishing profile 10 so as to form a monolithic assembly.

The component material(s) of the blocking parts and the method of manufacturing the blocking parts are of no importance for the invention. A blocking part can for example be made from plastic or metal and can for example be manufactured by extrusion, machining or molding.

To install the finishing profile on the two surfaces S1 and S2 to be connected, simply assemble the finishing profile 10 with one of the blocking parts P1A or P2A corresponding to the appropriate angular orientation (angle A1 or angle A2) of the wings 100 and 101 by inserting the adjusting shim 20*a* of the blocking part P1A or P2A into the groove 102 of the finishing profile. It then suffices to fix the assembly between the two surfaces to be connected by fitting the base 2 of the blocking part P1A or P2A into the rail 3 previously fixed between the two surfaces to be connected.

Figure 9:
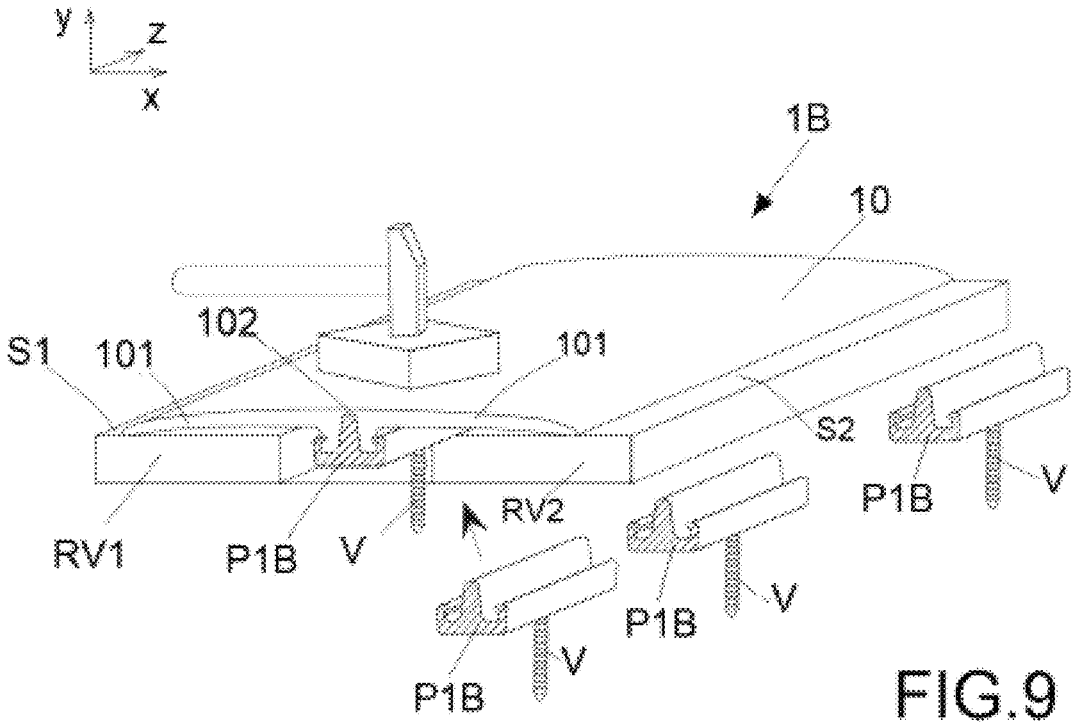
FIG. 9 is an isometric perspective view of a second variant embodiment of a finishing accessory according to the invention whose deformable finishing profile forms a transition between two floor coverings of substantially equal thickness, and which does not require a fastening rail.
Figure 10:
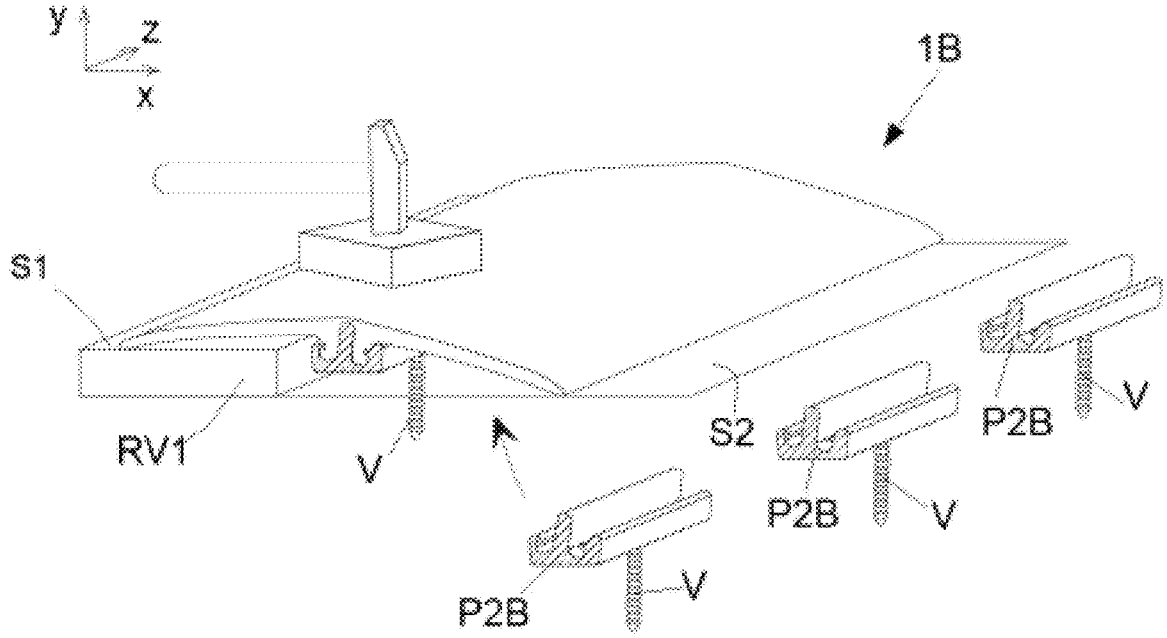
FIG. 10 is an isometric perspective view of said second variant embodiment of a finishing accessory according to the invention, the deformable finishing profile of which forms a transition between a floor covering and the floor.
Figure 11:
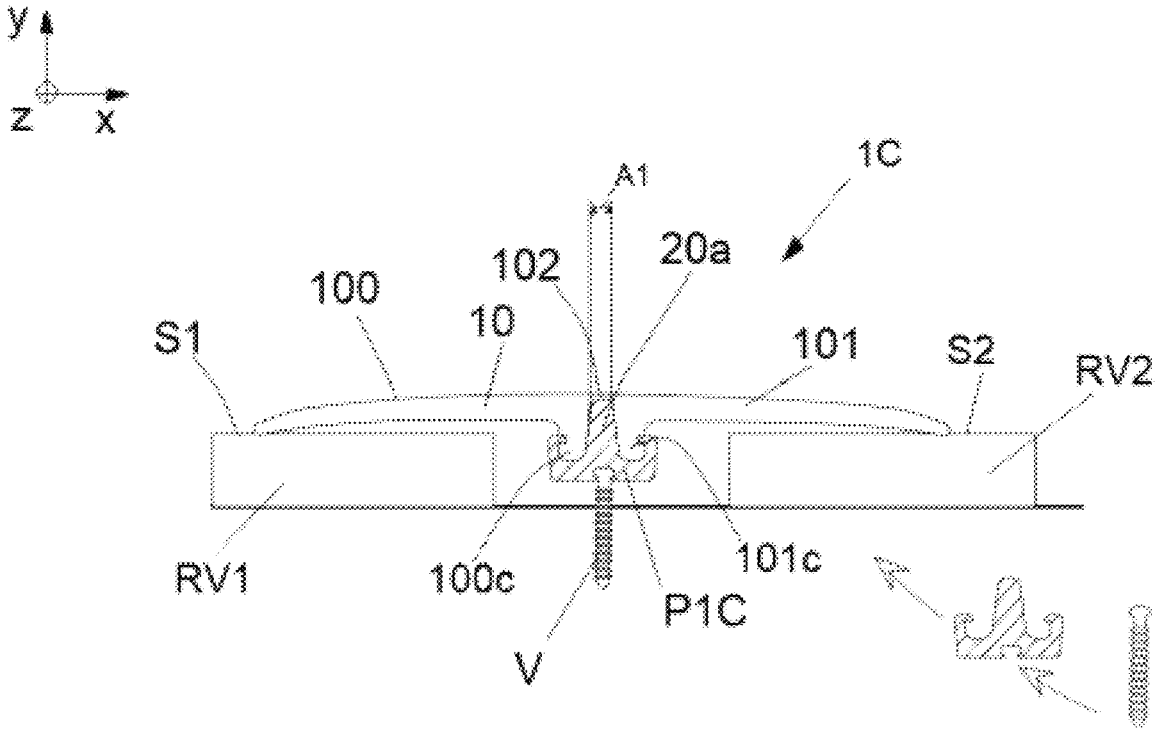
FIG. 11 is a cross-sectional view of a third variant embodiment of a finishing accessory according to the invention whose deformable finishing profile forms a transition between two floor coverings of substantially equal thickness, and which does not require a fastening rail.
Figure 12:
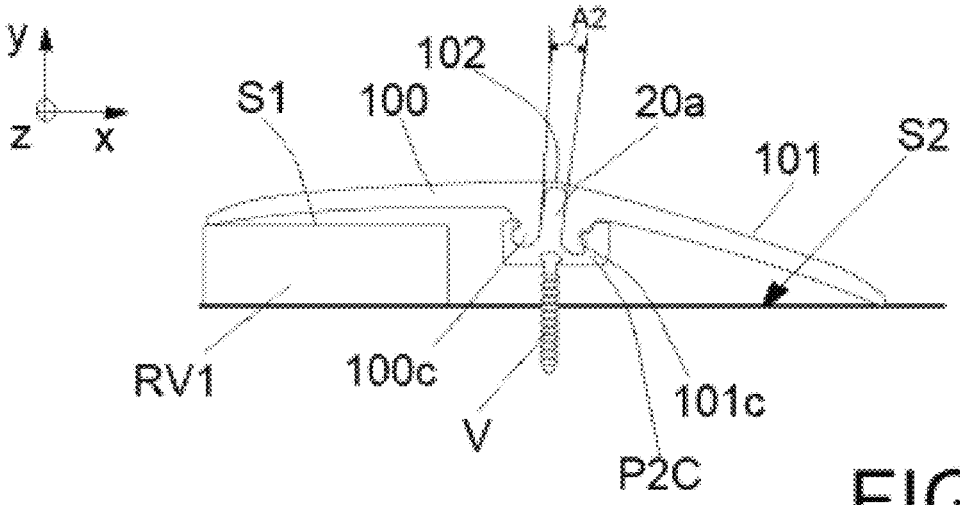
FIG. 12 is a cross-sectional view of said third variant embodiment of a finishing accessory according to the invention, the deformable finishing profile of which forms a transition between a floor covering and the floor.

FIGS. 9 and 10 show a second variant embodiment of a finishing accessory 1B comprising the deformable finishing profile 10 that has been previously described, and which in this variant can be used with two different types of blocking parts P1B and P2B. FIGS. 11 and 12 show a third variant embodiment of a finishing accessory 1C comprising the deformable finishing profile 10, which can be used with two different types of blocking parts P1C and P2C. In these two variants, the blocking parts include knock-in screws V for fixing the blocking part without using a rail, unlike the first variant of FIGS. 1 to 8.

Figure 13:
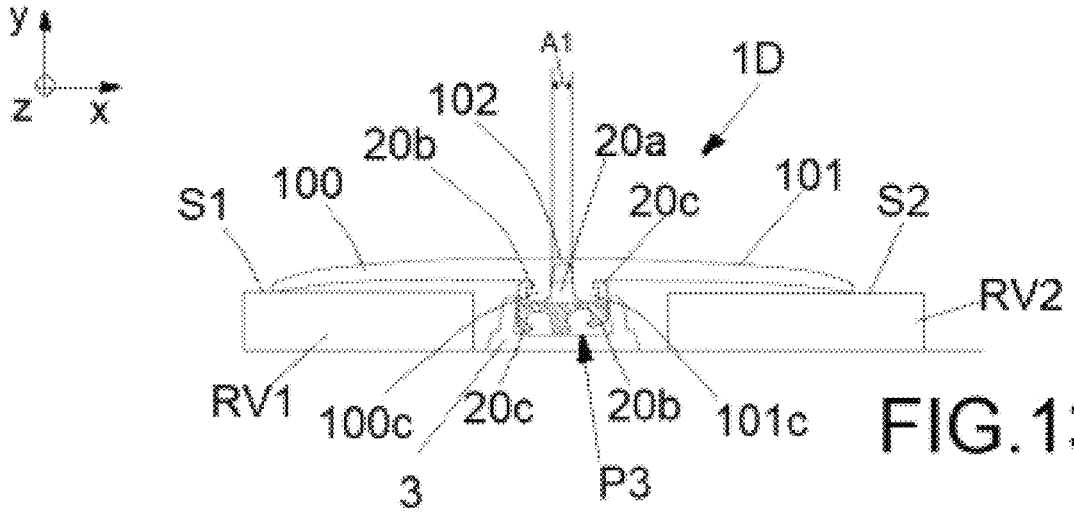
FIG. 13 is a cross-sectional view of a fourth variant embodiment of a finishing accessory according to the invention whose deformable finishing profile forms a transition between two floor coverings of substantially equal thickness, and which implements a reversible blocking part.
Figure 14:
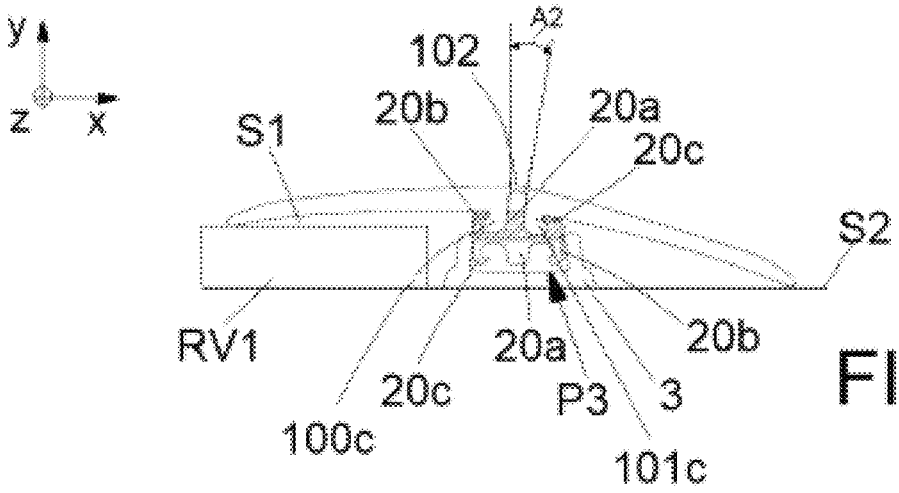
FIG. 14 is a cross-sectional view of said fourth variant embodiment of a finishing accessory according to the invention, the deformable finishing profile of which forms a transition between a floor covering and the floor.
Figure 15:
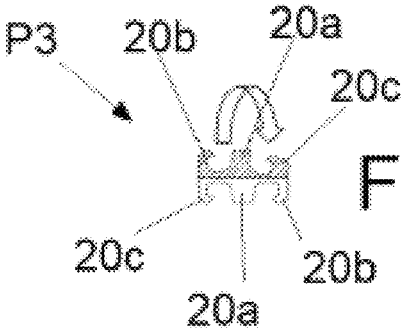
FIG. 15 is a cross-sectional view of the reversible blocking part of the fourth variant embodiment.

FIGS. 13 and 14 show a fourth variant embodiment of a finishing accessory 1D comprising the deformable finishing profile 10, which can be used with a blocking part P3 (FIG. 15) able to be fitted in a rail 3. This blocking part P3 is reversible so as to allow the two wings 100, 101 to be blocked in rotation with respect to at least two different angular orientations (FIG. 13 and FIG. 14) that depend on its assembly direction in the rail 3.

Figure 16:
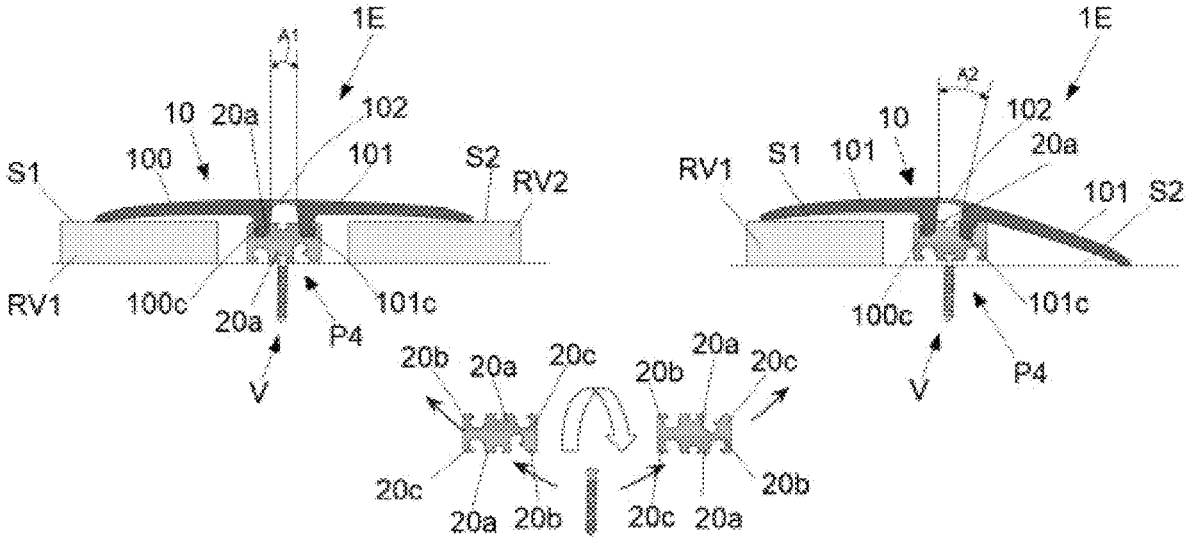
FIG. 16 is a cross-sectional view of a fifth variant embodiment of a finishing accessory according to the invention.

FIG. 16 shows a fifth variant embodiment of a finishing accessory 1E comprising the deformable finishing profile 10, which can be used with a blocking part P4 equipped with a knock-in screw V for fixing on a surface without the use of a fixing rail. This blocking part P4 is reversible so as to allow the two wings 100, 101 to be blocked in rotation with respect to at least two different angular orientations that depend on its assembly direction.

The finishing profile 10 previously described is a one-piece part. In another variant, the finishing profile could be a monolithic finishing profile, that is to say made up of a monolithic assembly of at least two parts. For example, in the context of the invention, at least one of the two wings 100 or 101 of a monolithic finishing profile could be detachable in a manner comparable to the solution of FIG. 14 of international patent application WO 2014/102518.

The invention is not limited to a finishing accessory having one or two angular positions for blocking the rotation of the wings 100 and 101, but also extends to a finishing accessory having three or more angular positions for blocking the rotation of the wings 100 and 101. Thus, in another variant, the finishing accessory could comprise three or more blocking parts, at the rate of one blocking piece for each different angular orientation of the wings 100 and 101, or could include a blocking part having three or more assembly directions, each assembly direction corresponding to a different angular orientation of the wings 100 and 101.

The finishing profile 10 that has been described has a central plane of symmetry, the two wings 100 and 101 being identical and symmetrical to one another with respect to this central plane of symmetry. The invention is not, however, limited to a symmetrical finishing profile, the two wings 100 and 101 being able to be different and not symmetrical to one another.

In the finishing profile 10 that has been described, the entire flexible hinge 102 is positioned between the two wings 100 and 101. In another variant, it could be only partly positioned between the two wings 100 and 101 and extend laterally so as to at least partly cover one and/or the other of the two wings 100, 101.

In the variant embodiments that have been described, the longitudinal rims 20*b*, 20*c* of the blocking parts that act as lateral stops for the projections 100*c*, 100*d* constitute rotational blocking means that are an integral part of each blocking part. In another variant embodiment, these rotational blocking means can be distinct and separate from the blocking part. For example, and in a nonlimiting manner, these rotational blocking means can be made up of an adhesive under each wing 100 and 101 so as to bond each wing 100 or 101 to the corresponding surface S1 or S2.

Figure 17:
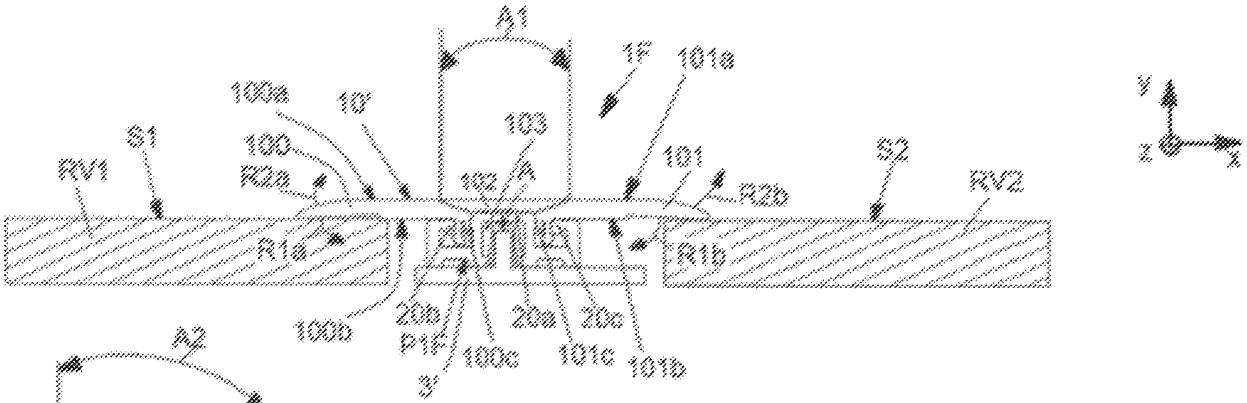
FIG. 17 is a cross-sectional view of a sixth variant embodiment of a finishing accessory according to the invention whose deformable finishing profile forms a transition between two floor coverings of substantially equal thickness.
Figure 18:
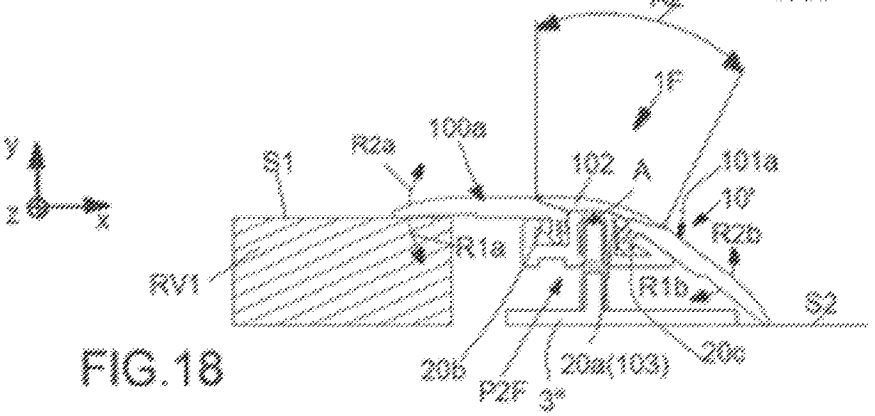
FIG. 18 is a cross-sectional view of said sixth variant embodiment of a finishing accessory according to the invention, the deformable finishing profile of which forms a transition between a floor covering and the floor.
Figure 19:
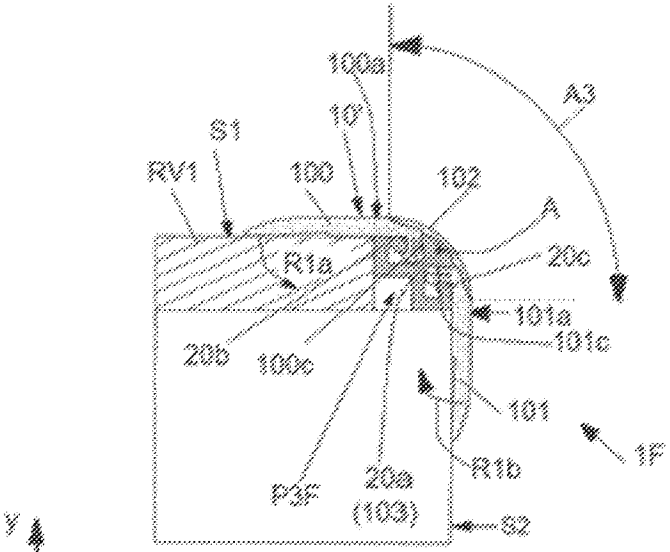
FIG. 19 is a cross-sectional view of said sixth variant embodiment of a finishing accessory according to the invention, the deformable finishing profile of which forms a transition, of the stair nosing type, between two surfaces oriented substantially perpendicularly to one another

FIGS. 17 to 19 show a sixth variant embodiment of a finishing accessory 1F having a deformable finishing profile 10' that can be used with three different blocking parts P1F, P2F and P3F.

Like for the profile 10 previously described, this profile 10' comprises two rigid wings 100 and 101, which are thin and of equal length, which extend lengthwise parallel to the longitudinal axis A, and which are interconnected over their whole length by a hinge 102 thinner than the wings 100 and 101.

This hinge 102 is positioned in its entirety between the two wings 100 and 101 and extends lengthwise parallel to said longitudinal axis A.

This flexible hinge 102 allows rotation of the two wings 100, 101 relative to one another in the plane (X, Y) perpendicular to the longitudinal axis A, preferably without stretching or compression of the hinge 102, and therefore without modifying the dimensions of the upper face of the flexible hinge 102.

Like for the profile 10 previously described, the wing 100 comprises, on its lower face 100*b*, a rigid longitudinal projection 100*c* that extends lengthwise parallel to said longitudinal axis A. The wing 101 has, on its lower face 101*b*, a rigid longitudinal projection 101*c* that extends lengthwise parallel to said longitudinal axis A. The flexible hinge 102 and the two longitudinal projections 100*c*, 101*c* define a longitudinal groove 103 between them that extends lengthwise parallel to the longitudinal axis A.

All of the technical considerations described above for the profile 10 also apply to this profile 10'.

The finishing profile 10' can be used with three different blocking parts P1F (FIG. 17), P2F (FIG. 18) and P3F (FIG. 19), each blocking part P1F, P2F, P3F corresponding to a different angular orientation (angles A1, A2, A3) of the two wings 100 and 101 relative to one another.

In a manner comparable to the other previously described variants of finishing accessories 1A to 1E, each blocking part P1F, P2F, P3F comprises an adjusting shim 20*a*, which extends lengthwise, which is capable of being inserted into said longitudinal groove 103. Once inserted into said longitudinal groove 103, the adjusting shim 20*a* acts as a stop preventing the two longitudinal projections 100*c* and 101*c* from being brought closer to one another so as to block the two wings 100, 101 in inward rotation relative to one another in the plane X, Y perpendicular to the longitudinal axis A and in the first directions of rotation R1*a*, R1*b* of the lower faces 100*b*, 101*b* of the wings 100, 101 towards one another, with a predefined angular orientation of the two wings 100 101 relative to one another.

In the variant of FIGS. 17 to 19, each blocking part P1F, P2F and P3F also comprises lateral stops 20*b* and 20*c* for rotational blocking, which extend lengthwise on either side of the adjusting shim 20*a* while being spaced apart from the adjusting shim 20*a*. These lateral stops 20*b* and 20*c* are able to cooperate with longitudinal projections 21 of the profile 10', so as to prevent the separation of the two longitudinal projections 100*c*, 101*c* relative to one another and to block the outward rotation of the two wings 100; 101 relative to one another in the plane X, Y perpendicular to the longitudinal axis A and in the directions of rotation R2*a*, R2*b* opposite the first directions of rotation R1*a*, R1*b*.

In the variants of FIGS. 17 and 18, each blocking part P1F and P2F is further able to be fitted onto a fixing rail 3', 3".

The blocking part P1F can be used to block the wings 100 and 101 of the finishing profile 10 with a first angular orientation of the wings 100 and 101, in which the two upper faces 100*a*, 101*a* of the two wings 100 and 101 are coplanar and form an external angle A1 (FIG. 17) of 180° between them. With this particular angular orientation of the wings 100 and 101, the finishing profile 10' can serve as a connection between two substantially coplanar surfaces S1 and S2.

The blocking part P2F can be used to block the wings 100 and 101 of the finishing profile 10 with a second angular orientation of the wings 100 and 101, in which the two upper faces 100*a*, 101*a* of the two wings 100 and 101 form an external angle A2 (FIG. 18) of between 180° and 270° between them, and for example an angle A2 on the order of 225°. With this particular angular orientation of the wings 100 and 101, the finishing profile 10' can serve as a connection between two surfaces S1 and S2 that are substantially parallel, but have a level difference (FIG. 18).

The blocking part P3F can be used to block the wings 100 and 101 of the finishing profile 10 with a third angular orientation of the wings 100 and 101, in which the two upper faces 100*a*, 101*a* of the two wings 100 and 101 form an external angle A3 (FIG. 19) of 270° between them. The angle A3 corresponds to the external angle between the upper faces 100*a* and 101*a* of the two wings 100 and 101, measured at the junctions of the hinge 102 with the wings 100 and 101. With this particular angular orientation of the wings 100 and 101, the finishing profile 10' can serve as a transition, for example of the stair nosing type, between two surfaces S1 and S2 that are substantially perpendicular to one another (FIG. 19).

The finishing accessory can be used as a transition between any type of surface S1 and S2, and is not limited to the finishing transition, of the transition bar type, between two floor coverings (RV1, RV2), or between a floor covering (RV1) and the floor, or a stair nosing type finishing transition. For example, the finishing accessory can be used as a finishing transition of the picture rail type, between two wall coverings, or between a wall covering and a wall on which the wall covering is fixed.

It is also advantageously possible to use the finishing accessory according to the invention as a plinth or the like, by cutting the finishing profile 10 in half along the hinge 102 so as to separate the two wings 100 and 101 from one another, each wing 100 and 101 thus being able to be used separately as a transition between a vertical wall P and a floor or floor covering, or between a vertical wall and a ceiling.

Figure 20:
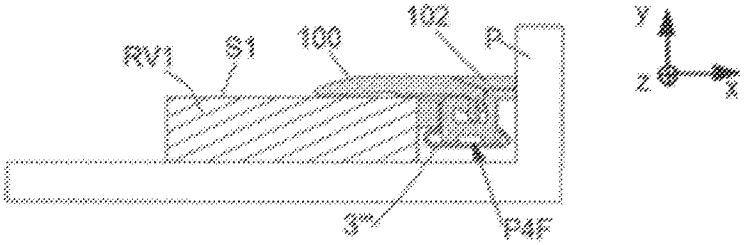
FIG. 20 is a cross-sectional view of said sixth variant embodiment of the finishing accessory according to the invention, when the flexible hinge of the finishing profile has been cut in half over its entire length, and only half of the profile is used as a stop transition between a vertical wall and a floor covering.

As an example, FIG. 20 shows a particular use of the finishing accessory 1F, once the flexible hinge 102 of the finishing profile 1F has been cut in half along its entire length. In this particular use, half of the finishing profile 1F is used as a stop transition between a vertical wall P and a floor covering RV1. More particularly, a fourth blocking part P4F is used, which is fitted into a rail 3''' fixed to the edge of the RV1 floor covering.

The invention claimed is:

1. A finishing accessory comprising a deformable finishing profile and at least one blocking part, said deformable finishing profile is suitable for making up a finishing transition between two surfaces, and comprises two rigid wings that extend lengthwise parallel to a longitudinal axis A, which are spaced from one another and which are intended to be in contact respectively with the two surfaces to be connected, and a flexible hinge that extends lengthwise parallel to said longitudinal axis A, which is, at least in part, positioned between the two rigid wings, and which connects the two rigid wings to one another, each rigid win has, on a lower face of each rigid wing, a rigid longitudinal projection that extends lengthwise parallel to said longitudinal axis A, the flexible hinge and the two rigid longitudinal projections define a longitudinal groove between the two rigid longitudinal projections, the flexible hinge allowing a rotation of each rigid wing and respective rigid longitudinal projection relative to the other rigid wing and other respective rigid longitudinal projection in a plane (X, Y) perpendicular to the longitudinal axis A, said at least one blocking part comprises an adjusting shim, which extends lengthwise, which is capable of being inserted into said longitudinal groove and which, once inserted into said longitudinal groove, acts as a stop preventing the two rigid longitudinal projections from being brought closer to one another so as to block an inward rotation of the two rigid wings in relation to one another in a plane (X, Y) perpendicular to the longitudinal axis A and in a first direction of rotation of the of rotation of lower faces of the two rigid wings towards one another, with a predefined angular orientation of the two rigid wings relative to one another.

2. The finishing accessory according to claim 1, wherein the flexible hinge is positioned between the two rigid wings, the flexible hinge extends over an entire length of the two rigid wings, an upper face of the flexible hinge is located in an extension of upper faces of the two rigid wings so as to form an upper face of the deformable finishing profile that is uniform without recess at a junction between each rigid wing and the flexible hinge, or a combination thereof.

3. The finishing accessory according to claim 1, further comprising a longitudinal rim for blocking in rotation that prevent a separation of the two rigid longitudinal projections relative to one another so as to block an outward rotation of the two rigid wings relative to one another in the plane (X, Y) perpendicular to the longitudinal axis (A) and in a direction of rotation of lower faces of the two rigid wings opposite a first directions of rotation, with a predefined angular orientation of the two rigid wings relative to one another.

4. The finishing accessory according to claim 3, wherein the longitudinal rim forms an integral part of the at least one blocking part.

5. The finishing accessory according to claim 3, wherein the longitudinal rim comprises two lateral stops that extend lengthwise on either side of the adjusting shim while being spaced apart from the adjusting shim and which have a function of laterally outwardly blocking the two rigid wings of the deformable finishing profile relative to one another.

6. The finishing accessory according to claim 1, further comprising at least two separate blocking parts, each of the at least two separate blocking parts corresponding to at least one different angular orientation of the two rigid wings, or wherein at least one blocking part is reversible so as to allow the two rigid wings to be blocked in rotation relative to one another in at least two different angular orientations, or a combination thereof.

7. The finishing accessory according to claim 1, wherein each blocking part is capable of being assembled with the deformable finishing profile so as to form an assembly.

8. The finishing accessory according to claim 1, further comprising a fixing rail with which the at least one blocking part is able to be fitted.

9. The finishing accessory according to claim 1, wherein the at least one blocking part comprises a knock-in screw.

10. The finishing accessory according to claim 1, wherein the deformable finishing profile is in one piece.

11. The finishing accessory according to claim 1, wherein a material forming the flexible hinge is different from a material forming the two rigid wings, the deformable finishing profile, or a combination thereof.

12. The finishing accessory according to claim 1, wherein said at least one blocking part is adapted to block the two rigid wings in inward rotation with respect to one another with an external angle (A1), between upper faces of the two rigid wings and measured at junctions of the flexible hinge with the two rigid wings equal to 180°, said at least one blocking part is adapted to block the two rigid wings in inward rotation with respect to one another with an external angle (A2), between upper faces of the two rigid wings and measured at junctions of the flexible hinge with the two rigid wings, of between 180° and 270°, and wherein said at least one blocking part is adapted to block the two rigid wings in inward rotation with respect to one another with an external angle (A3), between upper faces of the two rigid wings and measured at junctions of the flexible hinge with the two rigid wings, equal to 270°.

13. The finishing accessory according to claim 1, wherein the flexible hinge allows a rotation of the two rigid wings relative to one another in a plane (X, Y) perpendicular to the longitudinal axis (A), without stretching and without compression of the flexible hinge.

14. The finishing accessory according to claim 1, wherein said at least one blocking part is adapted to block the two rigid wings in inward rotation with respect to one another with an external angle (A1), between upper faces of the two rigid wings and measured at junctions of the flexible hinge with the two rigid wings equal to 180°, said at least one blocking part is adapted to block the two rigid wings in inward rotation with respect to one another with an external angle (A2), between upper faces of the two rigid wings and measured at junctions of the flexible hinge with the two rigid wings, of between 180° and 270°, or wherein said at least one blocking part is adapted to block the two rigid wings in inward rotation with respect to one another with an external angle (A3), between upper faces of the two rigid wings and measured at junctions of the flexible hinge with the two rigid wings, equal to 270°.

15. A use of a finishing accessory comprising a deformable finishing profile and at least one blocking part as a finishing transition between two surfaces, or between two floor coverings, or between a floor covering and a floor, or between two wall coverings, or between a wall covering and a wall on which the wall covering is fixed, or between two surfaces oriented transversely, or between two surfaces oriented perpendicularly, with respect to one another;

wherein said deformable finishing profile comprises two rigid wings that extend lengthwise parallel to a longitudinal axis A, which are spaced from one another and which are intended to be in contact respectively with the two surfaces to be connected, and a flexible hinge that extends lengthwise parallel to said longitudinal axis A, which is, at least in part, positioned between the two rigid wings, and which connects the two rigid wings to one another, each rigid wing has, on a lower face of each rigid wing, a rigid longitudinal projection that extends lengthwise parallel to said longitudinal axis A, the flexible hinge and the two rigid longitudinal projections define a longitudinal groove between the two rigid longitudinal projections, the flexible hinge allowing a rotation of each rigid wing and respective rigid longitudinal projection relative to the other rigid wing and other respective rigid longitudinal projection in a plane (X, Y) perpendicular to the longitudinal axis A; and wherein said at least one blocking part comprises an adjusting shim, which extends lengthwise, which is capable of being inserted into said longitudinal groove and which, once inserted into said longitudinal groove, acts as a stop preventing the two rigid longitudinal projections from being brought closer to one another so as to block an inward rotation of the two rigid wings in relation to one another in a plane (X, Y) perpendicular to the longitudinal axis A and in a first direction of rotation of the of rotation of lower faces of the two rigid wings towards one another, with a predefined angular orientation of the two rigid wings relative to one another.

16. A method of installing a finishing accessory comprising a deformable finishing profile and at least one blocking part to form a finishing transition between two surfaces, during which the two rigid wings of the deformable finishing profile are rotationally blocked by means of the at least one blocking part and said at least one blocking part is fixed between the two surfaces to be connected with the two rigid wings in contact respectively with the two surfaces to be connected;

wherein said deformable finishing profile comprises two rigid wings that extend lengthwise parallel to a longitudinal axis A, which are spaced from one another and which are intended to be in contact respectively with the two surfaces to be connected, and a flexible hinge that extends lengthwise parallel to said longitudinal axis A, which is, at least in part, positioned between the two rigid wings, and which connects the two rigid wings to one another, each rigid wing has, on a lower face of each rigid wing, a rigid longitudinal projection that extends lengthwise parallel to said longitudinal axis A, the flexible hinge and the two rigid longitudinal projections define a longitudinal groove between the two rigid longitudinal projections, the flexible hinge allowing a rotation of each rigid wing and respective rigid longitudinal projection relative to the other rigid wing and other respective rigid longitudinal projection in a plane (X, Y) perpendicular to the longitudinal axis A; and wherein said at least one blocking part comprises an adjusting shim, which extends lengthwise, which is capable of being inserted into said longitudinal groove and which, once inserted into said longitudinal groove, acts as a stop preventing the two rigid longitudinal projections from being brought closer to one another so as to block an inward rotation of the two rigid wings in relation to one another in a plane (X, Y) perpendicular to the longitudinal axis A and in a first direction of rotation of the of rotation of lower faces of the two rigid wings towards one another, with a predefined angular orientation of the two rigid wings relative to one another.

17. The method according to claim 16, wherein the two surfaces are substantially coplanar or wherein the two surfaces are non-coplanar and the deformable finishing profile is adapted to make up for a level difference between the two surfaces that are not coplanar or wherein the two surfaces are oriented transversely.

* * * * *